US008468953B2

(12) United States Patent
Ahrens

(10) Patent No.: US 8,468,953 B2
(45) Date of Patent: Jun. 25, 2013

(54) DEVICE FOR PIVOTING A FRONT HATCH AS WELL AS A FRONT HATCH MODULE

(75) Inventor: Michael Ahrens, Wolfenbüttel (DE)

(73) Assignee: Voith Patent GmbH, Heidenheim (DE)

( * ) Notice: Subject to any disclaimer, the term of this patent is extended or adjusted under 35 U.S.C. 154(b) by 211 days.

(21) Appl. No.: 13/155,886

(22) Filed: Jun. 8, 2011

(65) Prior Publication Data

US 2011/0296762 A1 Dec. 8, 2011

(30) Foreign Application Priority Data

Jun. 8, 2010 (EP) ..... 10165279

(51) Int. Cl.
*B60J 5/02* (2006.01)

(52) U.S. Cl.
USPC ..... 105/286; 105/299; 105/332; 105/1.1; 49/339; 49/340; 49/345

(58) Field of Classification Search
USPC ..... 105/257, 332, 335, 456, 1.1, 377.07, 105/377.05, 377.06, 283, 284, 299, 296; 49/339, 49/345, 405, 203, 205, 340, 344, 246, 248, 49/249, 254; 244/129.4, 129.5, 118.3
See application file for complete search history.

(56) References Cited

U.S. PATENT DOCUMENTS 3,333,362 A * 8/1967 Kostin et al. ..... 49/248
4,051,746 A * 10/1977 Liljeros ..... 74/520
4,497,462 A * 2/1985 Hamatani ..... 244/129.5
4,510,714 A * 4/1985 Kasper et al. ..... 49/249
5,275,303 A * 1/1994 Szalai ..... 220/264

(Continued)

FOREIGN PATENT DOCUMENTS

| | | |
|---|---|---|
| DE | 297 06 073 | 4/1997 |
| DE | 199 21 927 | 5/1999 |
| EP | 0 811 539 | 12/1997 |
| EP | 1 857 340 | 11/2007 |
| WO | WO 2007/073273 | 6/2007 |

OTHER PUBLICATIONS

European Search Report for European Patent Application No. 10 165 279, (Nov. 18, 2010).

*Primary Examiner* — Mark Le
(74) *Attorney, Agent, or Firm* — Dorsey & Whitney LLP

(57) ABSTRACT

A device can be provided for pivoting a front hatch of a track-guided vehicle, which can a reduced weight, while at the same time being able to reduce susceptibility to failure. The device can include a first pivot lever connectable to the front hatch and a second pivot lever connectable to the front hatch, where the pivot levers can be rotatable about a common rotational axis, to pivot the front hatch relative the vehicle chassis. The device can also include a first actuating element connectable to the vehicle chassis which can interact with the first pivot lever. For example, upon the first actuating element being actuated, torque can be exerted on the first pivot lever. A second actuating element can be provided which is connectable to the vehicle chassis, and which interacts with the second pivot lever. Upon the second actuating element being actuated, torque can be exerted on the second pivot lever. The device can further include a synchronization element (e.g., in the form of a rod-shaped element) extending along the common rotational axis which is connected to the first pivot lever on the one side and to the second pivot lever on the other so as to synchronize the rotational movement of the pivot levers.

15 Claims, 6 Drawing Sheets

U.S. PATENT DOCUMENTS 6,386,613 B1 * 5/2002 Vader ..... 296/50
7,143,548 B2 * 12/2006 Kleinmann et al. ..... 49/345
7,293,819 B2 * 11/2007 Duffy ..... 296/76
2001/0039762 A1 * 11/2001 Giovannetti ..... 49/246

* cited by examiner

DEVICE FOR PIVOTING A FRONT HATCH AS WELL AS A FRONT HATCH MODULE

CROSS-REFERENCE TO RELATED APPLICATION(S)

This application claims priority to European Patent Application No. EP 10 165 279.0, filed on Jun. 8, 2010, the disclosure of which is incorporated by reference herein in its entirety.

FIELD OF THE DISCLOSURE

The present disclosure relates to exemplary embodiments of a device for pivoting a front hatch, and specifically to exemplary embodiments of a front hatch device of a track-guided vehicle, in particular, a railway vehicle, as well as a front hatch module.

BACKGROUND INFORMATION

In conventional rail vehicle technology, it can be common to provide the front end of a trainset with a front hatch which covers the coupler pocket in the closed state to protect the structural elements or components of the coupling arrangement from environmental influences such as dirt, ice or icing. Such front hatch can additionally be accorded the function of eliminating aerodynamically disadvantageous frontal sections, which can be of particular importance in the case of streamlined trainsets such as high-speed trains.

Front hatches configured as a single-piece unit, as well as those configured as two-piece units, are used with conventional trainsets, both can be closed under normal conditions and might be opened only when the coupler needs to be used, for instance when two trainsets operate in double traction. A manually or automatically actuatable front hatch kinematics can be used to move a front hatch relative to the vehicle chassis and expose the working area for a central buffer coupling.

SUMMARY OF EXEMPLARY EMBODIMENTS

Exemplary embodiments according to the present disclosure can provide a front hatch kinematics, which can be of a simple design and characterized by its reliability. In particular, an exemplary embodiment of a device for pivoting a front hatch of a track-guided vehicle, as well as a front hatch module, can be provided in which, due to the structural simplicity, the total weight can be reduced at the same time the unit's susceptibility to failure is reduced.

According to certain exemplary embodiments of the present disclosure, a device to pivot a front hatch can solve this task, where the device can include a first pivot lever connectable to the front hatch and a second pivot lever connectable to the front hatch, wherein the two pivot levers are rotatable about a common rotational axis to pivot the front hatch relative the vehicle chassis. The device according to certain exemplary embodiments can further include a first actuating element connectable to the vehicle chassis as well as a second actuating element connectable to the vehicle chassis, where the first actuating element can interact with the first pivot lever such that upon the first actuating element being actuated, torque can be exerted on the first pivot lever. The second actuating element can interact with the second pivot lever such that upon said second actuating element being actuated, torque can be exerted on the second pivot lever. In accordance with this exemplary embodiment, a synchronization element, in the form of a rod-shaped element running the common rotational axis of the first and second pivot lever, can be further provided, whereby the synchronization element can be connected to the first pivot lever on the one side and to the second pivot lever on the other so as to synchronize the rotational movement of said pivot levers.

Accordingly, certain exemplary advantages achievable with the exemplary embodiments described herein are clear. For example, a rod-shaped synchronization-element can ensure or facilitate that the two actuating elements, which can be connected to the front hatch via the respective pivot lever, can be operated synchronously. As a consequence, the force used to pivot the front hatch can be divided between the two actuating elements. In particular, this can thereby reduce the load on the actuating mechanisms associated with the individual actuating elements, so as to significantly reduce the susceptibility of the front hatch kinematics to malfunction. In the event that one of the actuating elements malfunctions, the front hatch can still be pivoted since the motion of the two pivot levers used to pivot the front hatch are synchronized by the rod-shaped synchronization element.

In another exemplary embodiment according to the present disclosure, the actuating elements can each be configured in the form of a pneumatic, hydraulic or electrical actuating cylinder, including an extendable and retractable piston. This exemplary piston can interact with the associated pivot lever via an actuating mechanism. It is, for example, possible for the actuating mechanism to include a bell crank on the one hand and an eccentric disc on the other. In this exemplary embodiment, the piston of the associated actuating element can be articulated to the bell crank. On the other hand or in addition, the eccentric disc of the actuating mechanism can be connected to the end region of the rod-shaped synchronization element. In this exemplary embodiment of the front hatch kinematics, according to the present disclosure, it is possible for the bell crank to interact with the eccentric disc such that upon the respective actuating element being actuated, at least part of the torque acting on the bell crank is transmitted to the eccentric disc and from there to the rod-shaped synchronization element.

In a further exemplary embodiment of the present disclosure, the bell crank of the actuating mechanism can be connected to the vehicle chassis (e.g., vehicle frame) so as to be vertically pivotable to the vehicle's direction of travel, and also connected to the synchronization element via the eccentric disc. The term "bell crank," as used herein can be generally understood as, but not limited to, a mechanism designed to convert a translational motion of the eccentric disc into a rotational motion.

In still another exemplary embodiment of the present disclosure, the availing of a bell crank and an actuating mechanism including an eccentric disc interacting with the bell crank for operatively connecting the actuating element to the associated pivot lever can effect a rotational motion serving in turn to pivot the front hatch. According to such exemplary embodiment, e.g., the bell crank of each actuating mechanism can be rotatable relative the vehicle chassis about a rotational axis extending parallel to the rod-shaped synchronization element. The eccentric disc of each actuating mechanism can thereby be, e.g., rotatable relative to the vehicle chassis about the rotational axis common to the two pivot levers. This can constitute an exemplary solution for the actuating mechanism, and one also not prone to malfunction, for enabling the interaction of the respective actuating elements with the associated pivot levers.

In a still further exemplary embodiment of the present disclosure, the actuating elements can be respectively rotatable relative the vehicle chassis about a rotational axis extending parallel to the rod-shaped synchronization element, wherein the bell crank of each actuating mechanism can be rotatable relative the vehicle chassis about a rotational axis extending parallel to the rod-shaped synchronization element, and can include a sliding guide to forcibly guide the eccentric disc of the actuating mechanism. By providing such a sliding guide, the linear movement exerted by the actuating element can be converted into the rotational motion needed to pivot the front hatch relative the vehicle chassis.

According to still another exemplary embodiment of the present disclosure, the actuating mechanism can be provided that includes a connecting rod which is articulated to the bell crank of the actuating mechanism on the one side and to the eccentric disc of the actuating mechanism on the other. Each actuating element can be arranged with the associated actuating mechanism between two support plates fixedly connectable to the vehicle chassis in order to protect the delicate assembly of the front hatch kinematics. For example, each of the support plates can be situated in a plane perpendicular to the alignment of the rod-shaped synchronization element and be fixedly connected together by means of at least one spacer element.

In another exemplary embodiment of the present disclosure, at least two spacer elements can be included that can be used to connect the support plates, and for the bell crank of each actuating mechanism to be connected to a first of the at least two spacer elements so as to be rotatable about a rotational axis extending parallel to the rod-shaped synchronization element. Additionally, each actuating mechanism can further include a pressure spring, in particular a pneumatic spring, articulated to the eccentric disc of the actuating mechanism on the one side and to a second of the at least two spacer elements on the other. In order to be able to limit the relative motion of the pivot lever actuatable by one of the actuating elements arranged between the support plates, it is possible to provide a limit stop on at least one of the two support plates.

With respect to the linkage of the front hatch, according to one exemplary embodiment of the present disclosure, the respective first and second pivot lever can be pivotably connected to the front hatch about a rotational axis extending parallel to the rod-shaped synchronization element. At least a first additional pivot lever and a second additional pivot lever can be further provided which can interact with the first and second pivot lever, such that the first pivot lever and the first additional pivot lever, together with the second pivot lever and the second additional pivot lever, respectively form a quadruple joint using which the front hatch can be connected to the vehicle chassis. This can thereby facilitate the same to effect a movement relative to the vehicle chassis, which is a superposition of a linear and a pivoting motion in order to pivot the front hatch such that the clearance needed to pivot the front hatch can be reduced.

In another exemplary embodiment according to the present disclosure, a frame detachably can be provided which can be affixed to the vehicle chassis using which, the first and the second actuating element can be directly or indirectly connected to the vehicle chassis.

According to still another exemplary embodiment of the present disclosure, a front hatch module can be provided for a tracked-guided vehicle, e.g., a railway vehicle, where the front hatch module can include a front hatch made from a glass-fiber reinforced plastic, as well as a front hatch kinematics having a device of the type described in one of the exemplary embodiments herein, to pivot said front hatch.

These and other objects, features and advantages of the exemplary embodiments of the present disclosure will become apparent upon reading the following detailed description of the exemplary embodiments of the present disclosure, when taken in conjunction with the appended claims.

BRIEF DESCRIPTION OF THE DRAWINGS

Further objects, features and advantages of the present disclosure will become apparent from the following detailed description taken in conjunction with the accompanying figures showing illustrative embodiments of the present disclosure, in which.

Figure 1:
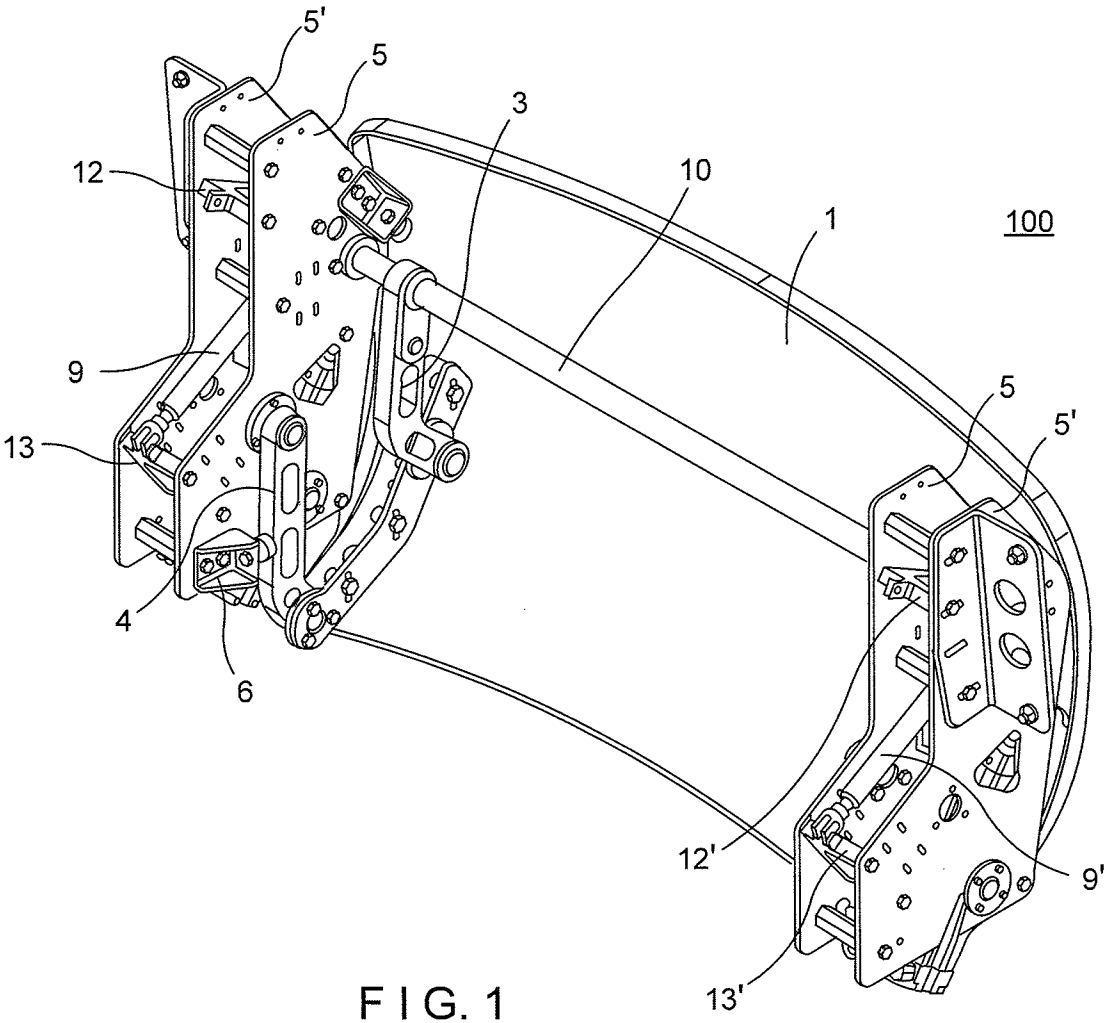
FIG. 1 is a perspective view of an exemplary front hatch module in accordance with an exemplary embodiment of the present disclosure.

Throughout the figures, the same reference numerals and characters, unless otherwise stated, are used to denote like features, elements, components or portions of the illustrated embodiments. Moreover, while the subject disclosure will now be described in detail with reference to the figures, it is done so in connection with the illustrative embodiments. It is intended that changes and modifications can be made to the described exemplary embodiments without departing from the true scope and spirit of the subject disclosure as defined by the appended claims.

DETAILED DESCRIPTION OF EXEMPLARY EMBODIMENTS

The following references the accompanying drawings in describing exemplary embodiments of a front hatch module 100 according to the present disclosure as shown in FIG. 1 which can utilize a device (e.g., front hatch kinematics) to pivot a front hatch 1.

As can be seen in FIG. 1, the depicted exemplary embodiment of the front hatch module 100 includes a single front hatch 1 which can be pivoted relative to a vehicle chassis (not shown) via two (or more) lateral drive units in order to expose the working area of a coupler which the front hatch 1 can cover. The lateral drive units, as can be used in the exemplary embodiment of the front hatch module 100 and which (e.g., as a whole) can constitute the front hatch kinematics, can be of a symmetrical configuration to facilitate a torque-free flow of force in the power train.

Figure 2:
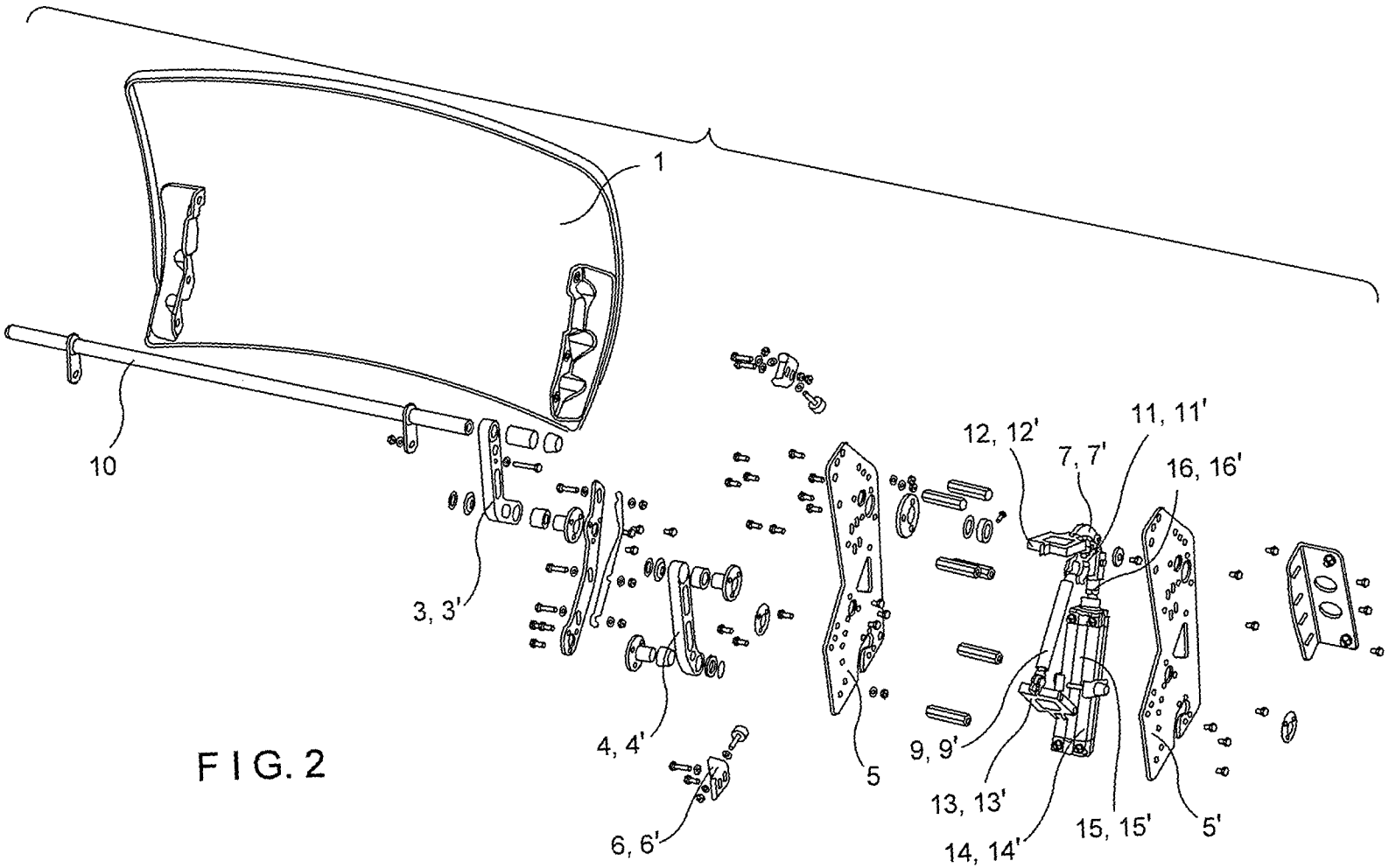
FIG. 2 is an exploded view of part of the components used in the front hatch module according to the exemplary embodiment shown in FIG. 1.

For example, each of the lateral drive units can include an actuating element 14, 14' and an actuating mechanism correspondingly associated with the actuating element 14, 14', as shown in FIG. 2. In particular, FIG. 2 depicts the individual exemplary components of one of the drive units together with exemplary front hatch 1.

Accordingly, e.g., each drive unit can comprise an actuating element 14, 14' which, according to an exemplary embodiment of the present disclosure shown in FIG. 2, can comprises a pneumatic, hydraulic or electrical actuating cylinder 15, 15' and a piston 16, 16' extendable/retractable from the actuating cylinder 15, 15' upon the actuating element 14, 14' being actuated. An actuating mechanism can be provided for each actuating element 14, 14' with which the linear force exerted on the piston 16, 16' of actuating element 14, 14' can be converted into a rotational motion in order to exert torque on a corresponding lever mechanism so as to pivot the front hatch 1 relative the vehicle chassis.

For example, as can be seen in the exemplary embodiment shown in FIG. 1, the pivoting mechanism can include a first pivot lever 3 detachably connected to the front hatch 1, as well as a second pivot lever 3' detachably connected to the front hatch 1. The first pivot lever 3 can interact with the first actuating element 14 of the first drive unit, and the second pivot lever 3' can interact with the second actuating element 14' of the second drive unit.

Figure 4:
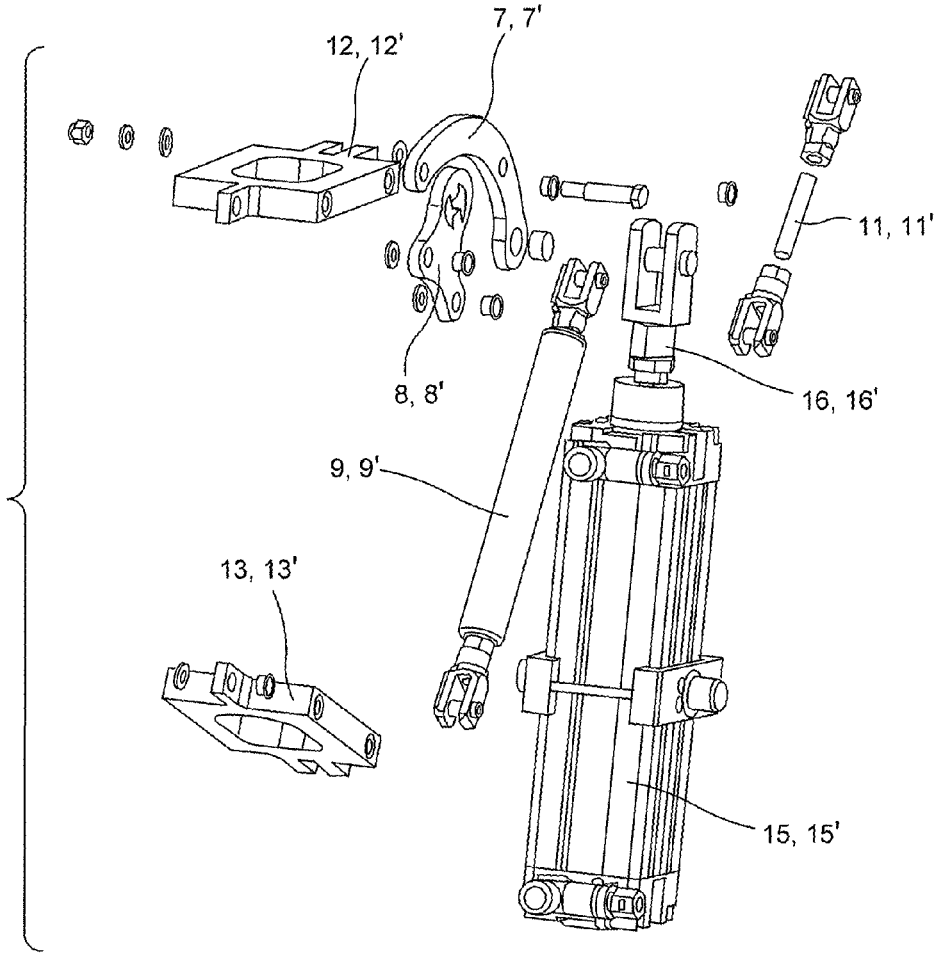
FIG. 4 is an exploded view of part of the actuating mechanism according to the exemplary embodiment shown in FIG. 3.
Figure 5A:
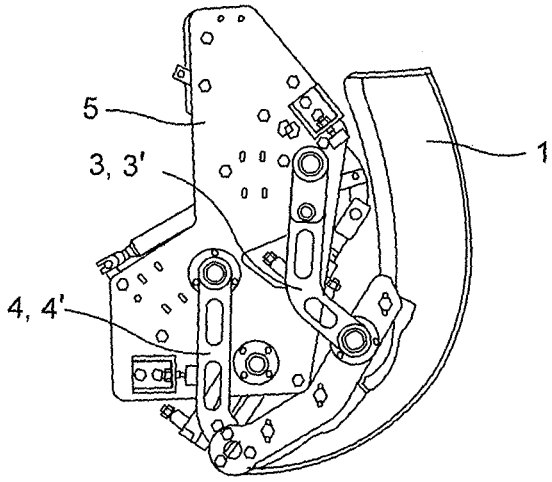
FIG. 5*a* is a side view of the front hatch module according to the exemplary embodiment shown in FIG. 1 in a closed state of the front hatch.
Figure 5B:
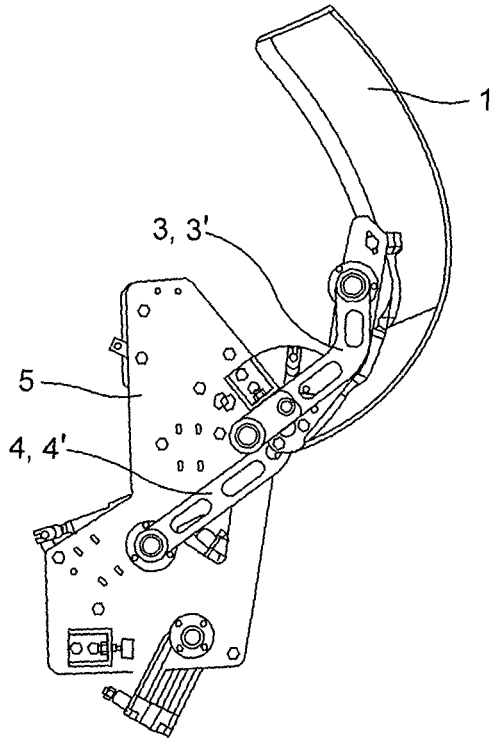
FIG. 5*b* is a side view of the front hatch module according to the exemplary embodiment shown in FIG. 1 in an opened state of the front hatch.

As illustrated in FIG. 4, each drive unit can include an actuating mechanism which can connect the respective actuating element 14, 14' to the associated pivot lever 3, 3'. In this exemplary embodiment of the present disclosure, the actuating mechanism can include a bell crank 7, 7' to and with which, the piston 16, 16' of the actuating element 14, 14' can be articulated. An eccentric disc 8, 8' can be further provided which can interact with the bell crank 7, 7' such that at least part of the torque acting on the bell crank 7, 7' upon the respective actuating element 14, 14' being actuated can be transmitted to the eccentric disc 8, 8'.

According to further exemplary embodiments of the present disclosure, it is possible to use two or more separate drive units, e.g., each including an actuating element 14, 14' and associated actuating mechanism to pivot the front hatch 1. It is also possible to provide a synchronization element 10 which can synchronize the rotational movement exerted on the associated pivot levers 3, 3' by the individual actuating elements 14, 14'. For example, as can be seen in FIG. 1, a rod-shaped element can be used in this exemplary embodiment as synchronization element 10 which can be situated on the common rotational axis R of the pivot levers 3, 3'. Thus, the rod-shaped synchronization element 10 can be connected on one side to the first pivot lever 3 and on the other to the second pivot lever 3'.

The respective end regions of the rod-shaped synchronization element 10 can be connected to the eccentric disc 8 of the actuating mechanism associated with the first actuating element 14 and to the eccentric disc 8' of the actuating mechanism associated with the second actuating element 14'. Thus, upon the actuation of at least one of the actuating elements 14, 14', the torque acting on the associated pivot lever 7, 7' can be transmitted to the associated eccentric disc 8, 8' and, from there, to the rod-shaped synchronization element 10.

Figure 6:
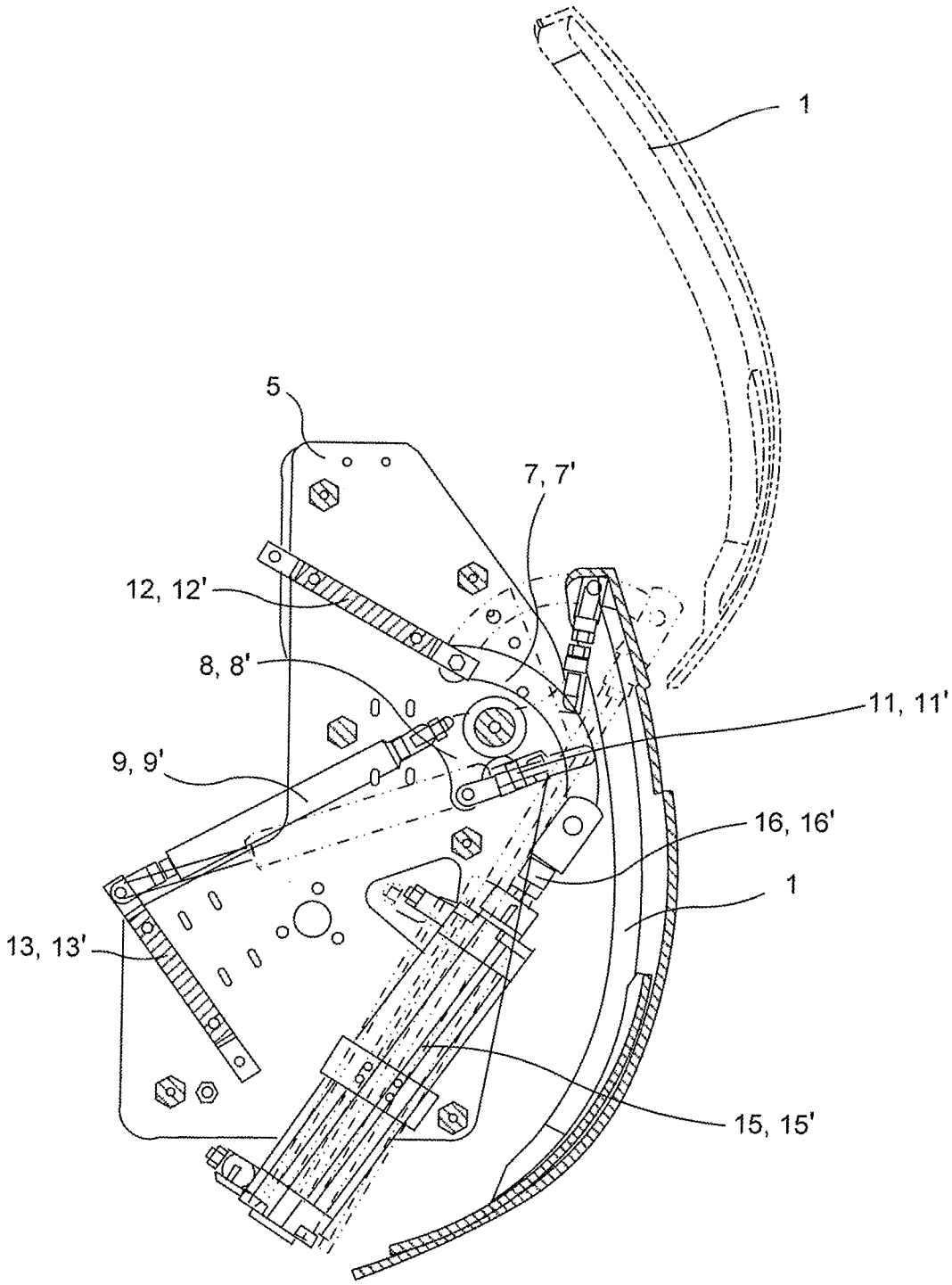
FIG. 6 is a partly sectional side view of the front hatch module according to the exemplary embodiment of FIG. 1 in closed/opened state(s) of the front hatch.

As seen in FIGS. 4 and 6, when viewed together, the exemplary embodiment of the exemplary front hatch module 100 provides for the bell crank 7, 7' of each actuating mechanism to be rotatable relative the vehicle chassis about a rotational axis extending parallel to the rod-shaped synchronization element 10. The eccentric disc 8, 8' of each actuating mechanism can be rotatable relative the vehicle chassis about the rotational axis R common to the two pivot levers 3, 3'.

An exemplary specific interaction between the bell crank 7, 7' and the eccentric disc 8, 8' of each actuating mechanism can be from the representation provided in FIG. 4, for example. As shown in FIGS. 4 and 6, the bell crank 7, 7' of each actuating mechanism can be rotatable relative the vehicle chassis about a rotational axis extending parallel to the rod-shaped synchronization element 10 and, can comprise a sliding guide, so as to forcibly guide the eccentric disc 8, 8' associated with the actuating mechanism. Each actuating mechanism can also include a connecting rod 11, 11' which can be articulated on the one side to the bell crank 7, 7' of the actuating mechanism and on the other to the eccentric disc 8, 8' of the actuating mechanism.

In another exemplary embodiment of the present disclosure, the exemplary front hatch kinematics, the actuating elements 14, 14' can be arranged with the associated actuating mechanism between two support plates 5, 5' fixedly connected to the vehicle chassis. For example, each of the support plates 5, 5' can be situated in a plane perpendicular to the alignment of the rod-shaped synchronization element 10, and fixedly connected together using two spacer elements 12, 13; 12', 13'. The use of such support plates 5, 5' can facilitate the actuating elements 14, 14' and the associated actuating mechanisms to be easily and effectively protected against damage.

As illustrated in FIG. 6, according to still another exemplary embodiment of the present disclosure, the bell crank 7, 7' of each actuating mechanism can be connected to a first spacer element 12, 12' so as to be rotatable about a rotational axis extending parallel to the rod-shaped synchronization element 10. In addition or alternatively, each actuating mechanism can include a pressure spring 9, 9', e.g., a pneumatic spring, which can be articulated on the one side to the eccentric disc 8, 8' of the actuating mechanism and on the other to a second spacer element 13, 13'. Each actuating element 14, 14' can be connected to the two respective support plates 5, 5' so as to be rotatable about a rotational axis extending parallel to the rod-shaped synchronization element 10.

Figure 3:
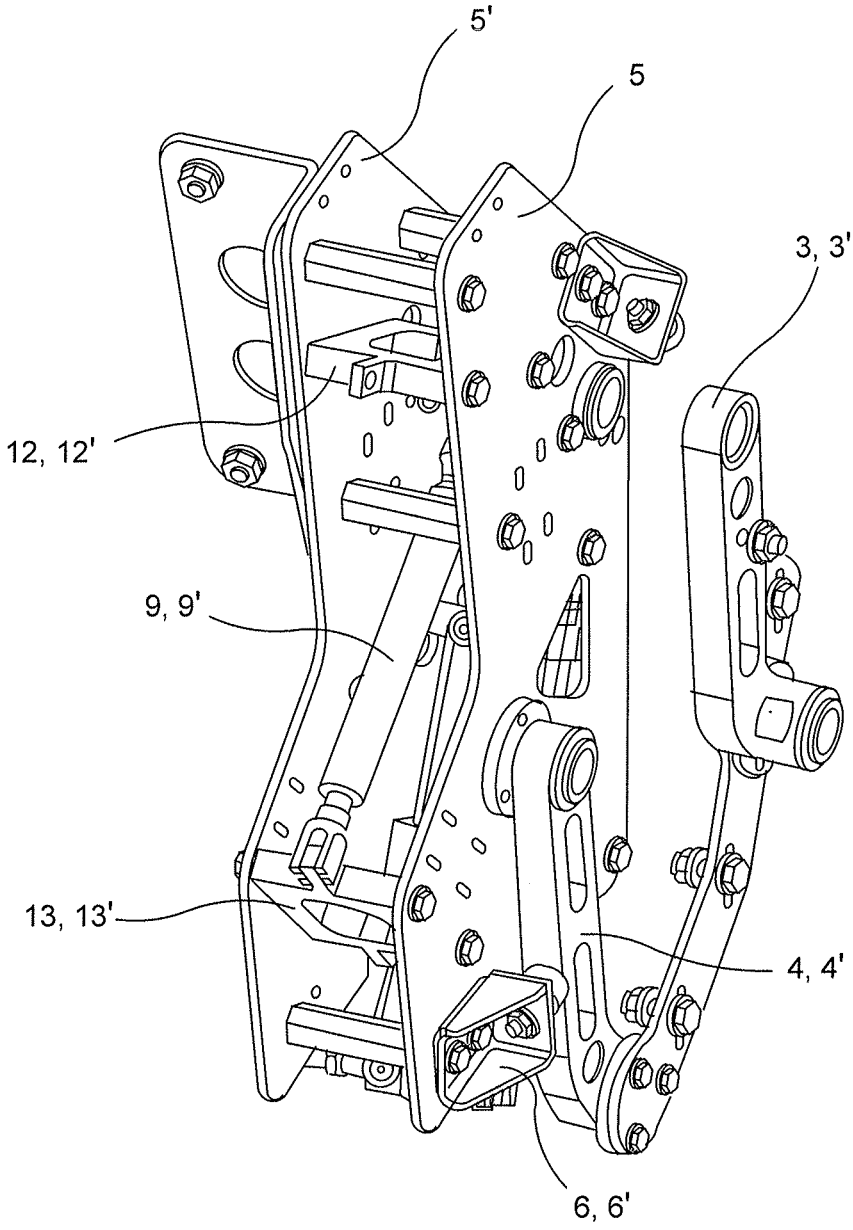
FIG. 3 is a perspective view of an exemplary actuating mechanism with associated actuating element of the front hatch module according to the exemplary embodiment shown in FIG. 1.

FIG. 3 shows that a limit stop 6, 6' can be provided on one of the two support plates 5, 5' so as to be able to limit the relative movement of the pivot lever 3, 3' actuatable by the actuating elements 14, 14' arranged between the support plates 5, 5'.

In one exemplary embodiment of the present disclosure, the first and the second pivot lever 3, 3' can be respectively connectable to the front hatch 1 so as to be pivotable about a rotational axis extending parallel to the rod-shaped synchronization element 10. First and second additional pivot levers 4, 4' can also be provided which interact with the first and the second pivot lever 3, 3'. For example, the first pivot lever 3 and the first additional pivot lever 4, together with the second pivot lever 3' and the second additional pivot lever 4', respectively, can form a quadruple joint with which, the front hatch 1 can be connected to the vehicle chassis.

The exemplary embodiments of the present disclosure described herein are not limited to the exemplary embodiments depicted in the drawings. For example, in another exemplary embodiment, a frame can be provided which is detachably affixed to the vehicle chassis, where the first and second actuating elements 14, 14' are connected to the exemplary frame.

Exemplary embodiments of the present disclosure can utilize two or more symmetrically-configured drive units to pivot the front hatch 1, where each of the drive units can comprise an actuating element 14, 14' and an actuating mechanism to exert torque on the associated pivot lever 3, 3' upon the actuating element 14, 14' being actuated. The pivot levers 3, 3' of the two drive units can be coupled together using the rod-shaped synchronization element 10 such that the two drive units can be redundant. If one of the drive units fails, one drive unit can be used in performing the function and facilitating the pivoting of the front hatch 1 relative the vehicle chassis. The exemplary embodiments shown in the drawings can provide the two or more drive units which can be constructed of identical components, where these drive units can then be symmetrical and can be realized economically. The exemplary symmetrical configuration of the drive units can facilitate a torque-free flow of force in the power train.

The foregoing merely illustrates the exemplary principles of the present disclosure. Various modifications and alterations to the described embodiments will be apparent to those skilled in the art in view of the teachings herein. It will thus be appreciated that those skilled in the art will be able to devise numerous modification to the exemplary embodiments of the present disclosure which, although not explicitly shown or described herein, embody the principles of the disclosure and are thus within the spirit and scope of the disclosure. Further, the exemplary embodiments described herein can operate together with one another and interchangeably therewith. All publications, applications and patents cited above, if any, are incorporated herein by reference in their entireties.

What is claimed is:

1. A device for pivoting a front hatch of a track-guided vehicle, comprising:

a first pivot lever connectable to the front hatch;

a second pivot lever connectable to the front hatch, wherein the two pivot levers are rotatable about a common rotational axis to pivot the front hatch relative a chassis of the vehicle;

a first actuating element connectable to the chassis which is configured to interact with the first pivot lever, wherein upon the first actuating element being actuated, a first torque is exerted on the first pivot lever;

a second actuating element connectable to the chassis which is configured to interact with the second pivot lever, wherein, upon the second actuating element being actuated, a second torque is exerted on the second pivot lever;

a synchronization element extending along the common rotational axis and which is connected to the first pivot lever on a first side and to the second pivot lever on a second side so as to synchronize the rotational movement of the first and second pivot levers, wherein the first and second pivot lever are respectively connectable to the front hatch to be pivotable about a rotational axis extending parallel to the synchronization element; and a third pivot lever and a fourth pivot lever which are configured to interact with the first and second pivot lever, wherein the first and third pivot levers and with the second and fourth pivot levers, respectively, form a quadruple joint, wherein the front hatch is connectable to the vehicle chassis via the quadruple joint, and wherein each of the first and second actuating elements comprises an actuating cylinder having an extendable and retractable piston.

2. The device according to claim 1, wherein the first and second actuating elements interact with the associated first and second pivots lever via an actuating mechanism, wherein the actuating mechanism includes:

a bell crank to which the piston of the respective element of the first and second actuating elements is articulated; and an eccentric disc connected to an end region of the synchronization element, and wherein the bell crank interacts with the eccentric disc, and wherein, upon an actuation of the respective actuating element of the first and second actuating elements, at least part of a third torque acting on the bell crank is transmitted to the eccentric disc and to the synchronization element.

3. The device according to claim 2, wherein the bell crank of each of the first and second actuating mechanisms is rotatable relative the chassis about the rotational axis, and wherein the eccentric disc of each of the first and second actuating mechanisms is rotatable relative the chassis about the common rotational axis.

4. The device according to claim 2, wherein the first and second actuating elements are respectively pivotable relative the chassis about the rotational axis, and wherein the bell crank of each of the first and second actuating mechanisms is rotatable relative the chassis about the rotational axis and includes a sliding guide to guide the eccentric disc of the respective actuating mechanism.

5. The device according to claim 2, wherein each of the first and second actuating mechanisms further comprises a connecting rod which is articulated to the bell crank of the respective actuating mechanism on a first side thereof and to the eccentric disc of the respective actuating mechanism on a second side thereof.

6. The device according to claim 2, wherein each of the first and second actuating elements is arranged with another one of the first and second actuating mechanisms between at least two support plates fixedly connectable to the chassis.

7. The device according to claim 6, wherein each of the first and second actuating elements is connected to a respective one of the support plates so as to be rotatable about the rotational axis.

8. The device according to claim 6, wherein the support plates are respectively situated in a plane that is perpendicular to an alignment of the synchronization element and fixedly connected to one another by at least one spacer element.

9. The device according to claim 8, wherein the at least one spacer element includes a plurality of spacer elements, and wherein the bell crank of each of the first and second actuating mechanisms is connected to a first spacer element of the spacer elements so as to be rotatable about the rotational axis.

10. The device according to claim 8, wherein the at least one spacer element includes a plurality of spacer elements, and wherein each of the first and second actuating mechanisms includes a pressure spring which is articulated to the eccentric disc of the actuating mechanism on a first side and to a second spacer element of the spacer elements on a second side.

11. The device according to claim 6, further comprising a limit stop provided on at least one of the support plates to limit a relative motion of at least one of the pivot levers actuatable by at least one respective element of the first and second actuating elements arranged between the support plates.

12. The device according to claim 1, further comprising:

a frame detachably affixed to the chassis, wherein the first and second actuating elements are connected to the frame.

13. The device according to claim 1, wherein the device is configured to be attached to a front hatch comprising a glass-fiber reinforced plastic.

14. The device according to claim 1, wherein the actuating cylinder is at least one of pneumatic, hydraulic or electrical.

15. The device according to claim 1, wherein the track-guided vehicle is a railway vehicle.

* * * * *